US005823117A

United States Patent [19]

Ommerli

[11] Patent Number: 5,823,117

[45] Date of Patent: Oct. 20, 1998

[54] PASSENGER PASSAGEWAY FOR RAIL VEHICLES

[75] Inventor: Arnold Ommerli, Flurlingen, Switzerland

[73] Assignee: Fiat-Sig Schienenfahrzeuge AG, Neuhausen, Switzerland

[21] Appl. No.: 765,968

[22] PCT Filed: May 15, 1996

[86] PCT No.: PCT/CH96/00186

§ 371 Date: May 5, 1997

§ 102(e) Date: May 5, 1997

[87] PCT Pub. No.: WO96/36519

PCT Pub. Date: Nov. 21, 1996

[30] Foreign Application Priority Data

May 16, 1995 [CH] Switzerland ..... 1427/95

[51] Int. Cl.[6] ..... B61D 17/00

[52] U.S. Cl. ..... 105/8.1; 105/21; 105/15

[58] Field of Search ..... 105/8.1, 9, 10, 105/15, 16, 17, 18, 20, 21

[56] References Cited

U.S. PATENT DOCUMENTS

| | | | |
|---|---|---|---|
| 389,427 | 9/1888 | Bissell et al. | 105/21 |
| 2,643,617 | 6/1953 | Nystrom et al. | 105/15 |
| 3,712,244 | 1/1973 | Vollenweider et al. | 105/21 |
| 4,765,249 | 8/1988 | Ishizuka et al. | 105/21 |

FOREIGN PATENT DOCUMENTS

| | | | |
|---|---|---|---|
| 0054458 | 6/1982 | European Pat. Off. . | |
| 0329031 | 8/1989 | European Pat. Off. . | |
| 140285 | 3/1928 | Switzerland | 105/20 |
| 9506580 | 3/1995 | WIPO . | |

*Primary Examiner*—Mark Tuan Le

*Attorney, Agent, or Firm*—Ostrolenk, Faber, Gerb & Soffen, LLP

[57] ABSTRACT

The passenger connecting passageway between two rail vehicles includes a respective half-passageway at the end of each vehicle. Each half-passageway has a respective main frame. To lock the half-passageways together, a locking device including at least one locking hook and preferably a pair of hooks is arranged on the outside of one vertical support of the main frame of one half-passageway. A receiving pin on the adjacent main frame of the other half-passageway receives the hook and a device swings the hook selectively on and off the pin. A swingable pull together device on the inside of the half-passageway includes a pull strap supported at the vertical support on one half-passageway that hooks on a receiver on the vertical support on the other half-passageway and a ratchet rotates an arm that winds the strap to pull the half-passageways together.

17 Claims, 5 Drawing Sheets

PASSENGER PASSAGEWAY FOR RAIL VEHICLES

BACKGROUNG OF THE INVENTION

The present invention relates to a passenger passageway between rail vehicles or railway cars and consisting of two extractable and retractable half-passageways arranged at the ends of the cars to be coupled with each other. The half-passageways have centering and locking devices on their directly opposite main frames. The locking device consist of locking hooks which are arranged on a vertical support of each half-passageway and they are connected for movement with each other, consist of corresponding receivers on the opposite vertical support, and consist of an actuating device for the locking hooks.

Passenger passageways of this type operate today without the previously customary positive guidance of the passageway but rather with a free equilibrium guidance of the diaphragm which is limited by stops. The passageways thereby have a shorter installation length on smooth end walls with stable bridging and support structures and locks. These passageways furthermore have vandalism-proof inner sheathing.

The object of the present invention is to provide, in passenger passageway of the type described above, on the one hand a locking device which is simple to operate and, on the other hand, a device, also of a simple nature, for the pulling of the half-passageways together against the restoring forces of diaphragms and possibly of restoring springs. These devices are to be arranged on the passageway itself, to take up the smallest amount of space but to optimally function.

This object is achieved in accordance with the invention. The passenger connecting passageway between two rail vehicles includes a respective half-passageway at the end of each vehicle. Each half-passageway has a respective main frame. To lock the half-passageways together, a locking device including at least one locking element, in the form of a hook and preferably a pair of hooks is arranged on the outside of one vertical support of the main frame of one half-passageway. A receiving pin on the adjacent main frame of the other half-passageway receives the hook. A device swings the hook selectively on and off the pin.

There is a swingable pull together device on the inside of the half-passageway including a pull strap supported at the vertical support on one half-passageway that hooks on a receiver on the vertical support on the other half-passageway. A ratchet rotates an arm that winds the strap to pull the half-passageways together.

The present invention makes it possible, in a very simple manner, to lock the half-passageways of coupled cars to each other and to pull the half-passageways together into the position required for the locking. Other features of the invention are explained in somewhat more detail below on the basis of embodiments shown in the drawings.

DESCRIPTION OF THE PREFERRED EMBODIMENT

A complete passenger passageway between two rail vehicles consists of two entirely identical half-passageways. Due to their arrangement with mirror-symmetry contact elements, cars equipped with this type of passageway can be freely coupled. This means that upon the coupling of the cars, each car end fits any other car end.

Figure 1:
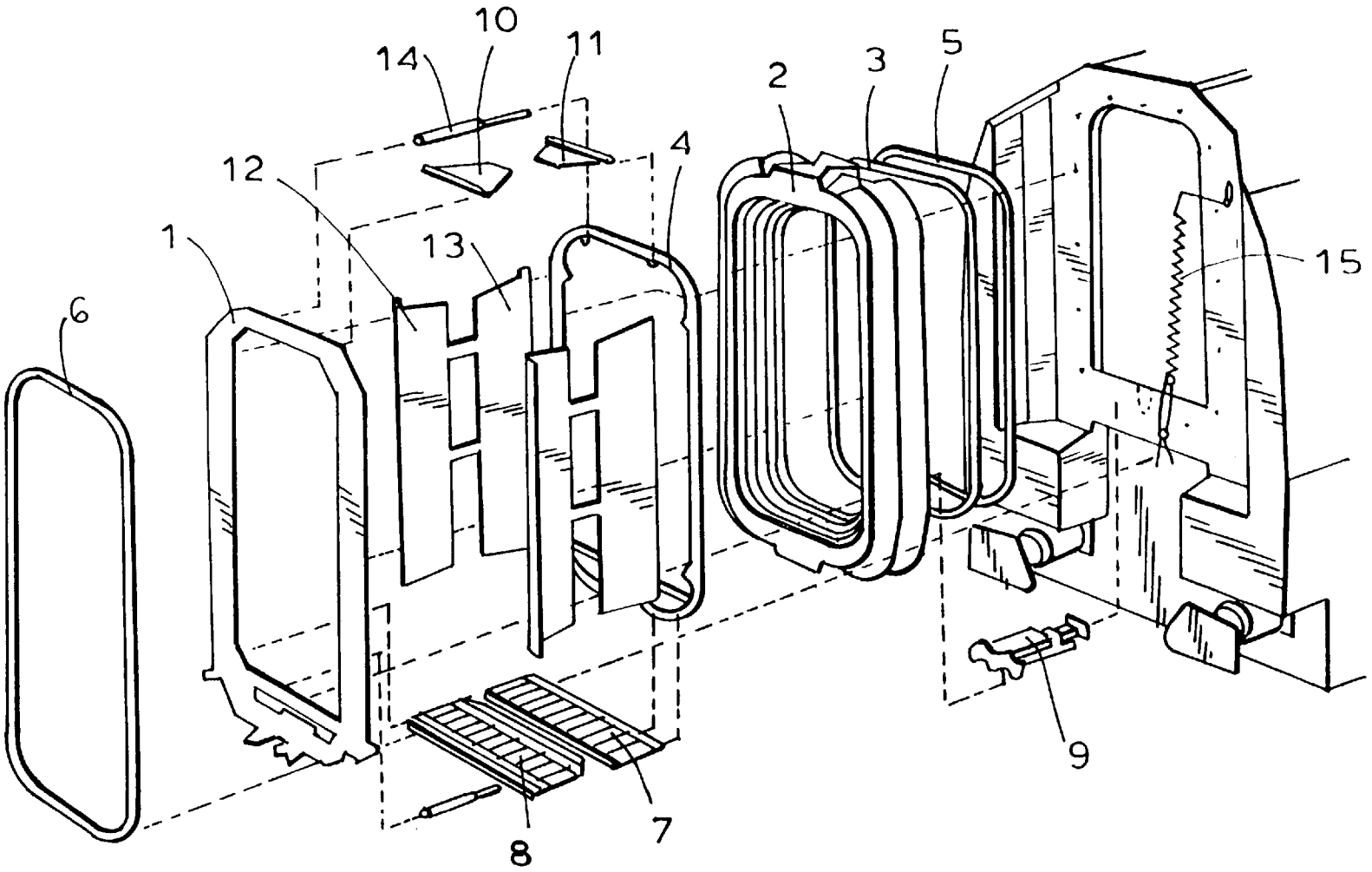
FIG. 1 is an exploded sketch of a half-passageway (the half-passageways being identical to each other)

As shown in FIG. 1, each half-passageway consists of a main frame 1 with centering elements. The frame 1 is being attached in dust-tight and water-tight manner to a one-piece flexible diaphragm 2 by means of clamping ledges 3 on a mounting frame 4. The mounting frame 4 is bolted to the body of the car. Between the mounting frame 4 and the body of the car there is a packing 5, and on the coupling surface of the main frame 1 there is a packing 6. Thus, after the coupling of the transition halves there is a completely air-tight, dust-tight and water-tight connection of the cars under all conditions of operation which occur.

On the mounting frame 4 and the main frame 1 there are mounted, turnable around the transverse axis, movable bridge elements 7 and 8 respectively, one bridge element lying on the other.

The bridge elements 7 and 8 are supported by a three-part support telescope 9.

Within the diaphragm 2, ceiling sheathing elements 10 and 11 are arranged on the main frame 1 and the mounting frame 4 respectively.

For the safety of the passengers, but also in order to protect the diaphragm from vandalism, two side sheathing elements 12 and 13 which are movable in themselves are arranged on the main frame 1 and the mounting frame 4 respectively.

The coupling of the two half-passageways is effected manually via in each case a pair of locking hooks (see FIGS. 6 to 9) for each half, the pair engaging in corresponding bolts on the main frame 1 of the other half-passageway.

In uncoupled condition each half-passageway is held by two bearing springs 15 of adjustable length from the car body to the main frame 1. In coupled condition these bearing springs 15 stabilize the passageway.

In uncoupled condition, the opening of the passenger passageway can be closed in an air-tight, dust-proof, and water-tight manner by a multi-part closure cover (not shown in the exploded sketch).

Figure 2:
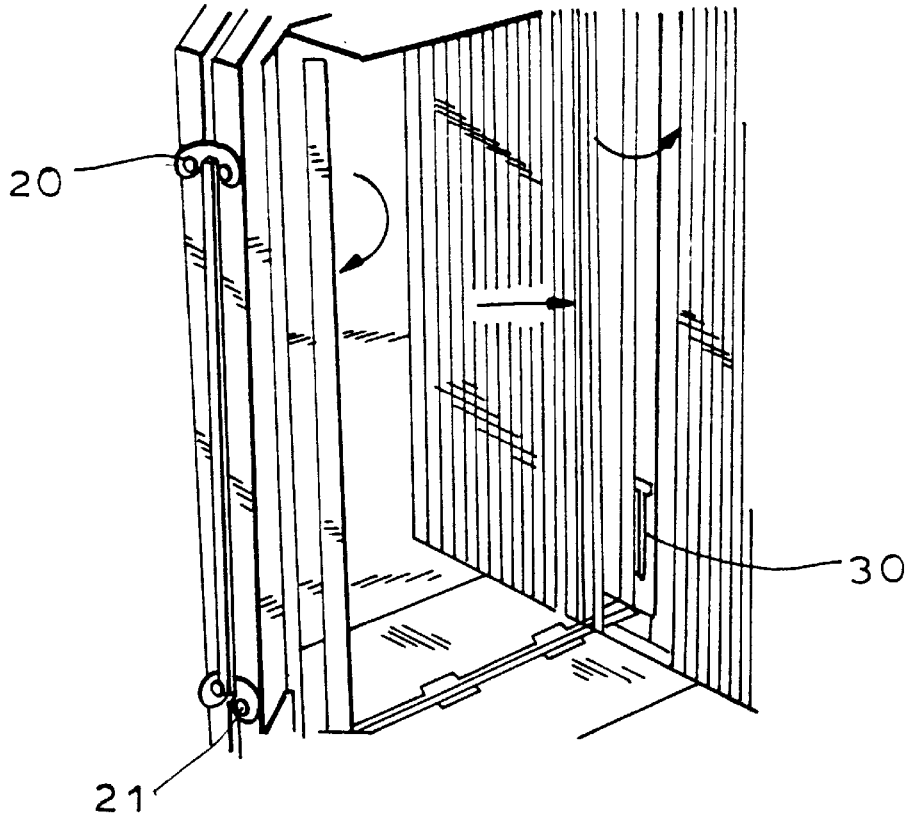
FIGS. 2 and 3 show, diagrammatically two half-passageways in locked and unlocked condition respectively.
Figure 3:
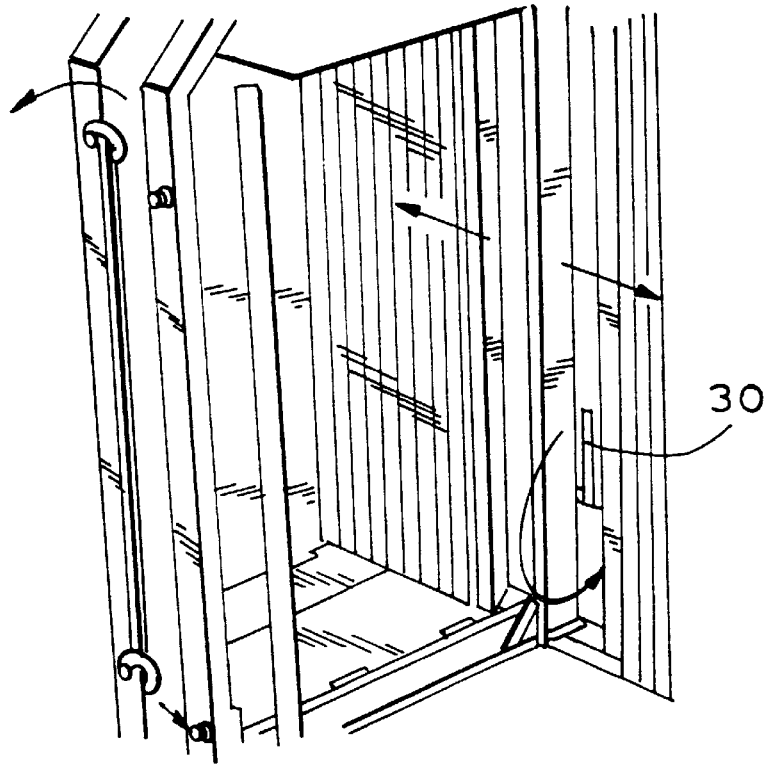

FIGS. 2 and 3 show, in purely diagrammatic manner, portions of two half-passageways resting against each other, together with the locking device for these half-passageways in closed and in open condition respectively. The locking device will be described in further detail below with reference to FIGS. 6 to 9 (a fastening device for the locking hooks is present in each case on the left-side vertical support of the main frame).

Figure 4:
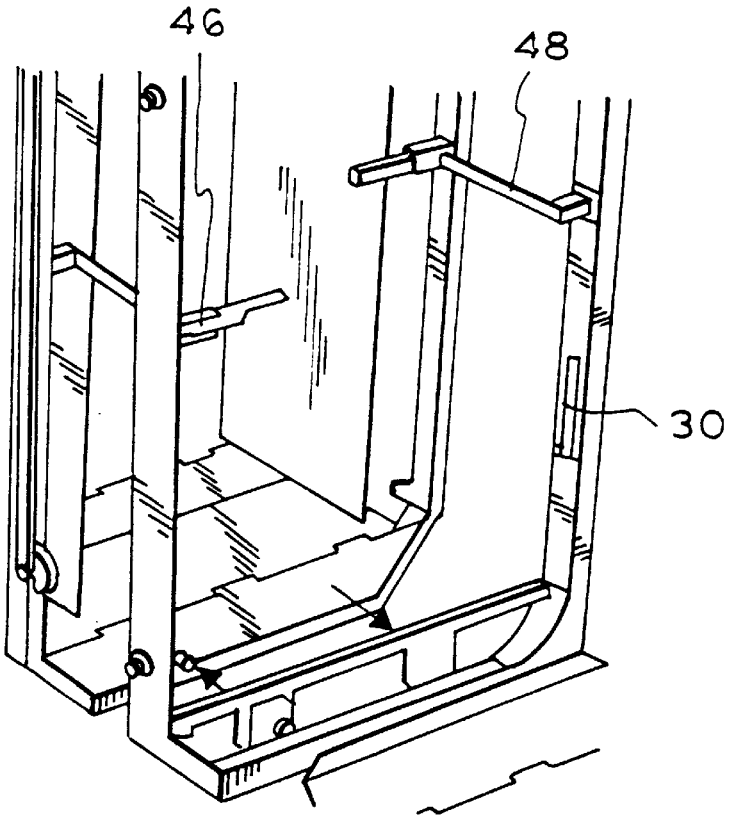
FIGS. 4 and 5 show, diagrammatically two passageway halves before they are pulled together by the tensioning device.
Figure 5:
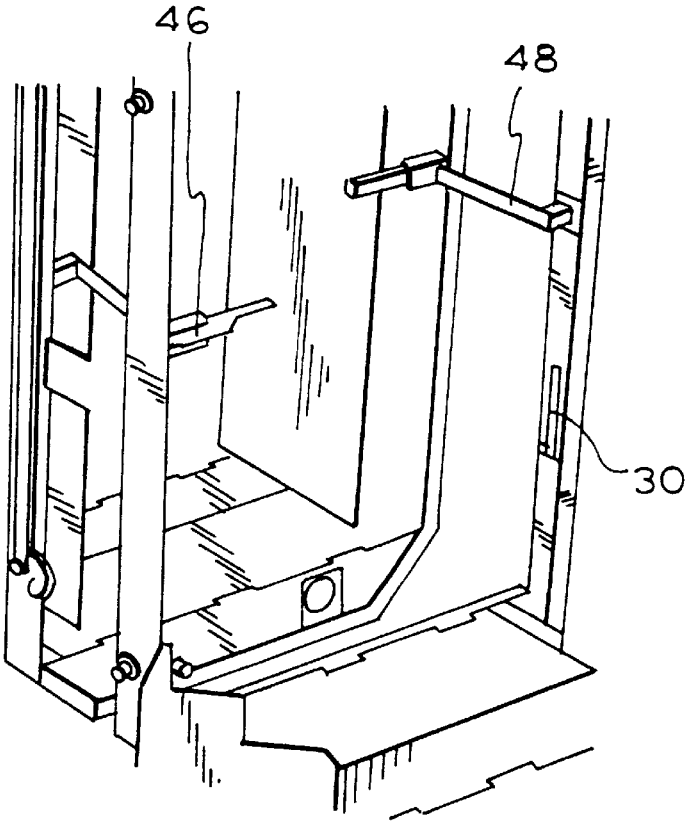
Figure 9:
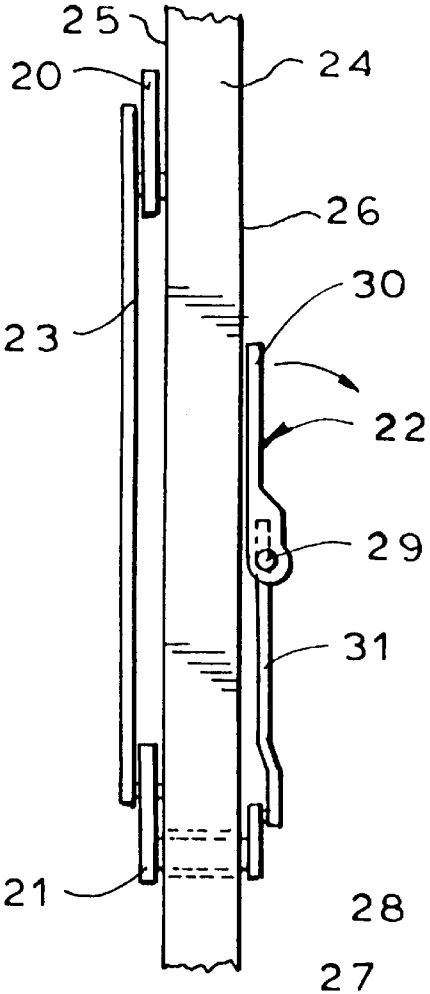
FIGS. 6 to 9 show, diagrammatically the mechanism of the locking device.
Figure 8:
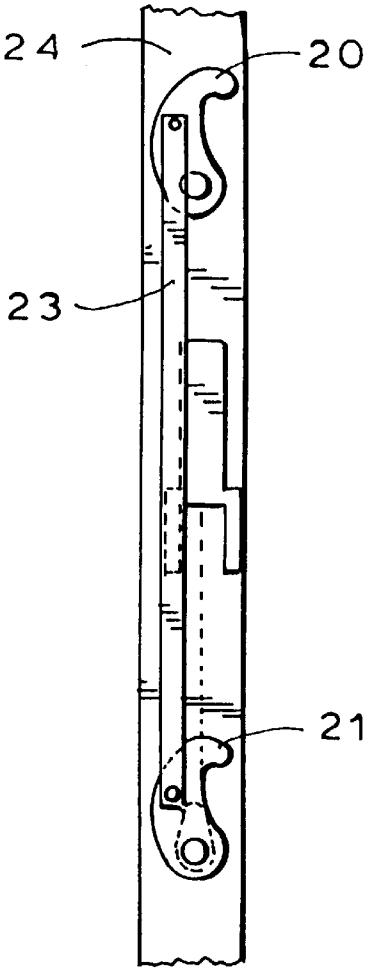
Figure 7:
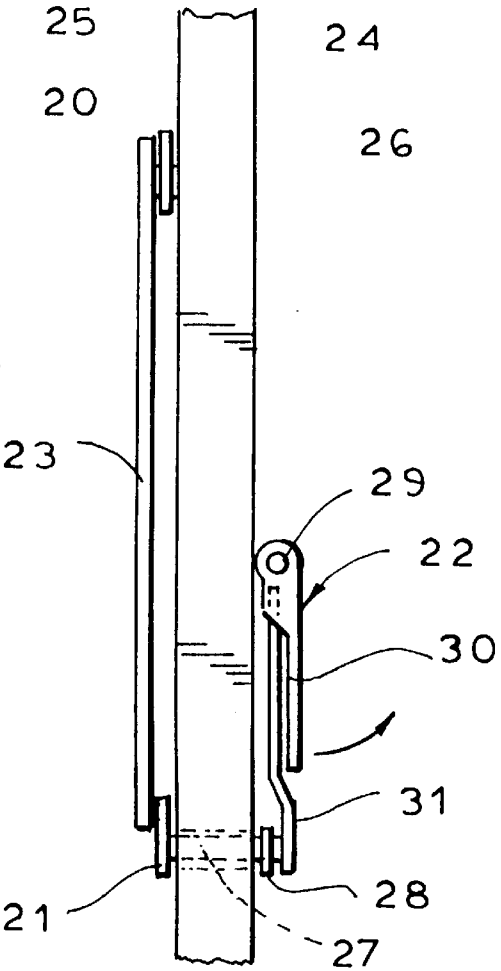
Figure 6:
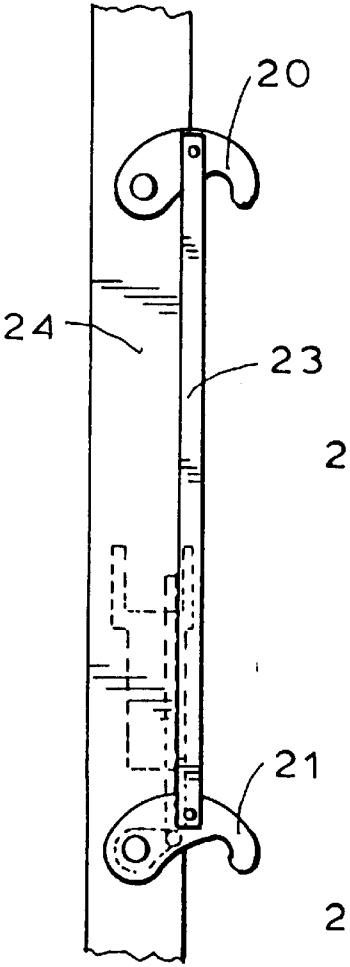

Similarly, FIGS. 4 and 5 show, in purely diagrammatic manner, two half-passageways which are to be locked to each other with means for pulling the half-passageways together against the action of restoring forces for the half-passageways. In this way, even half-passageways which are not aligned with respect to each other are pulled against each other in locking position. The pulling-together device will be described further below, with reference to FIG. 10.

FIGS. 6 to 9 show, in purely diagrammatic manner, a part of a locking device, namely in each case a pair of locking hooks 20, 21 and the corresponding actuating device 22.

The locking device consists of two locking hooks 20, 21 which are connected with each other by a connecting rod 23 so that they are swingable at all times parallel to each other. The pair of locking hooks is arranged swingably on the outside 25 of a vertical support 24 of the main frame of each half-passageway, namely always on the same side on each passageway, so that coupling is always possible.

In accordance with the present invention, the actuating device 22 for the pair of locking hooks 20, 21 is located on the inside 26 of the vertical support 24 (behind the inner sheathing).

The actuating device 22 consists of a shaft 27 on the outer end of which the hook 21 is seated, while a crank element 28 (lever arm) is arranged on its inner end. At a distance above the crank element 28 an actuating lever 30 which can swing about a horizontal pin 29 is arranged on the support 24. The lever 30 is so connected by a pull or push rod 31 to the crank element 28 that, by a swinging of the actuating lever downward or upward by 180°, the shaft 27 is turned through a desired angle, preferably 90°, in order thereby also to swing the pair of hooks 20, 21 through said angle, namely from an open locking position into a closed locking position and vice versa.

The locking hooks 20, 21, in the closed locking position, engage receiving pins on the outside of the vertical support of the facing half-passageways.

As shown also in FIGS. 2 and 3, the half-passageways which have been moved against each other can be locked to each other from the inside of the passageway by means of the actuating lever 30.

The locking device developed in accordance with the invention together with the pulling-together device for the half-passageways which is described below makes it possible for a single person to place trains in condition ready for operation.

Figure 10:
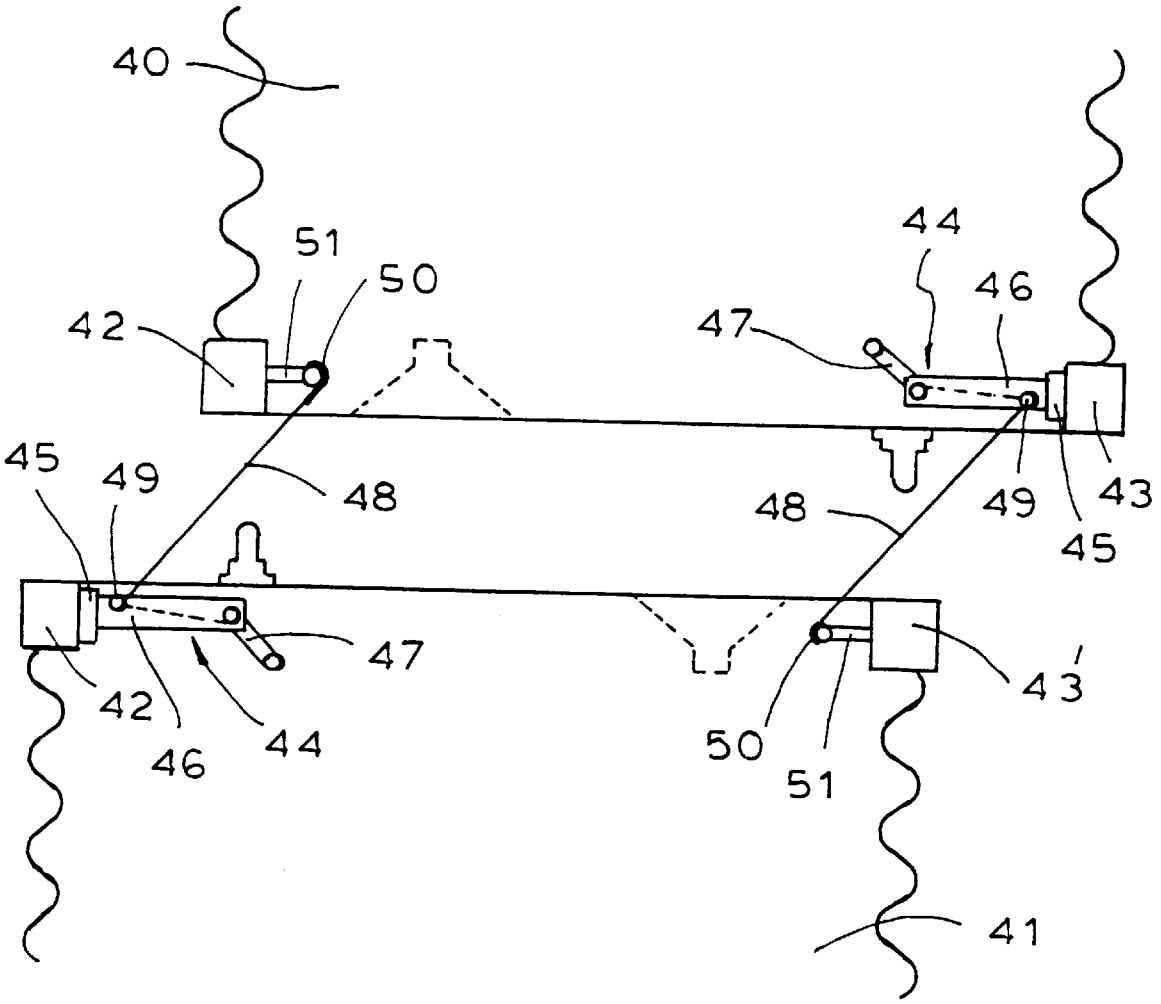
FIG. 10 shows the mechanism of the pulling-together device for two half-passageways.

FIG. 10 of the drawing shows, in purely diagrammatic manner, two half-passageways 40, 41 with the vertical supports 42, 43 and 42', 43' of the main frame and the pulling-together device for such half-passageways. That device is important primarily in the case of half-passageways which are not aligned with each other, for instance on slight curves.

On each of the vertical supports 43, and 42' there is arranged a tensioning device 44 consisting of an arm 46 which is swingable about a horizontal axis 45. On the free end of the arm a ratchet 47 is arranged for the winding or unwinding of a strap 48. The strap 48 is wound or unwound by the backward and forward movement of the ratchet lever. The strap 48 passes outward over a guide roller 49 in the swing arm 46. The free end of the strap bears a hook 50 which is intended to be attached in a receiver 51 (hook eye) on the vertical support 43' or 42 respectively of the opposite main frame of the other half-passageway.

Due to this device, half-passageways can be easily brought by a single person into a desired position even against larger forces (preparation for locking).

Normally, if it is not required for pulling-together the half-passageways, the tensioning device is swung back towards the vertical support. It is preferably concealed in locked condition of the passageway by unfoldable inner sheathing elements. This is possible also for the hook receivers 51.

I claim:

1. A passenger passageway for placement between two rail vehicles, the passageway comprising:

two extendible and retractable half-passageways, each of the half-passageways arrangeable on the end of one of the rail vehicles and the half-passageways being coupleable to each other;

each half-passageway having a respective main frame, the half-passageways being positioned so that their main frames face each other;

each half-passageway having a respective vertical support at the opposite lateral sides of the half-passageway;

a locking device at the main frame of one of the half-passageways, the locking device comprising at least a locking element on the vertical support of the one half-passageway and at least a receiver on an adjacent vertical support on the other half-passageway shaped and placed so that the locking element can be locked onto the receiver, the one half-passageway having an inside;

an actuating device located on the inside of the one half-passageway and connected with the locking element for moving the locking element onto and off the receiver, the actuating device including a shaft which extends through the respective vertical support;

the shaft having an outside end on which the locking element is fastened for being turned by turning of the shaft so that the locking element is swung between an open position wherein the locking element is off the receiver to a locking position with the locking element on the receiver;

the shaft having an inside end toward the inside of the half-passageway, a crank on the inside end of the shaft, and an actuating lever connected with the crank such that swinging of the actuating lever turns the shaft and the locking element on the shaft; and a drive connection between the actuating device and the locking element for moving the locking element selectively onto and off the receiver.

2. The passenger passageway of claim 1, wherein the locking element comprises a hook and the receiver comprises a pin on which the hook is received.

3. The passenger passageway of claim 1, further comprising a rod connected with the crank for rotating the crank to rotate the shaft;

an actuating lever supported on a horizontal axis located on the vertical support, the actuating lever being connected with the rod so that movement of the actuating lever between first and second positions respectively moves the rod to rotate the crank to rotate the shaft to move the locking element between the open and closed locking positions.

4. The passenger passageway of claim 3, wherein the locking element comprises a hook and the receiver comprises a pin on which the hook is received.

5. The passenger passageway of claim 3, wherein the actuating lever is swingable about the axis between the first and second positions which are 180° separated.

6. The passenger passageway of claim 5, wherein the rod is so pivoted to the actuating lever that swinging of the actuating lever through 180° swings the crank and the shaft through an angle in the range of 45° to 120°.

7. The passenger passageway of claim 5, wherein the rod is so pivoted to the actuating lever that swinging of the actuating lever through 180° swings the crank and the shaft at through angle in the range of about 90° to 120°.

8. The passageway of claim 1 wherein said at least a locking element comprises a pair of the locking elements on the vertical support of the one half-passageway, and wherein said at least a receiver comprises a respective pair of receivers on the adjacent vertical support of the other half-passageway and placed for having the locking elements lock onto the receivers and move off the receivers;

said pair of locking elements being connected such that actuation of the actuating device for moving one of the locking elements moves both of the locking elements together.

9. The passenger passageway of claim 8 further comprising a connecting rod between the pair of locking elements for guiding the locking elements for parallel movement.

10. The passenger passageway of claim 8, wherein each of the locking elements comprises a hook and each of the receivers comprises a pin on which the hook is received.

11. The passenger passageway of claim 1, further comprising a first centering device provided on the facing vertical supports of the main frames of the half-passageways for centering the main frames with reference to each other and for pulling the half-passageways together, the centering device comprising:

a manually actuated tensioning device comprising a strap support mounted on one of the vertical supports of the main frame of at least one of the half passageways, a strap windable on and unwindable from the strap support, an engaging element disposed on a free end of the strap, and means for winding the strap on the strap support for drawing an adjacent one of the vertical supports of the other half-passageway toward the one vertical support of the at least one half-passageway; and an engageable element on the adjacent vertical support of the main frame of the other half-passageway, wherein the engaging element of the strap is coupleable on the engageable element.

12. The passenger passageway of claim 11, further comprising a second centering device provided on the facing vertical supports laterally opposite to said first centering device.

13. The passenger passageway of claim 11, wherein the strap support is arranged on an inner side of the one vertical support, and the engageable element is arranged on an inner side of the adjacent vertical support.

14. The passenger passageway of claim 11, wherein the tensioning device comprises an arm supported to rotate about an axis extending away from the vertical support, a ratchet provided on the arm pivotally to enable manual winding and unwinding of the strap at the arm.

15. The passenger passageway of claim 14, further comprising a guide roller in the arm, and the strap is conducted away from the ratchet over the guide roller in the arm.

16. A passenger passageway for placement between two rail vehicles, the passageway comprising:

two extendible and retractable half-passageways with each of the half-passageways arrangeable on the end of one of the vehicles and the half-passageways being coupleable to each other;

each half-passageway having a respective main frame, the half-passageways being positioned so that their main frames face each other;

a respective centering device provided on the facing main frames of the half-passageways for centering the main frames with reference to each other and for pulling the half-passageways together, the centering device comprising a manually actuated tensioning device mounted on a vertical support of the main frame of one of the half-passageways, the tensioning device comprising a strap support on the vertical support, a strap windable on and unwindable from the strap support, the strap having a free end with an engaging element thereon, and an engageable element on a vertical support of the main frame of the other half-passageway, wherein the engaging element of the strap is coupleable on the engageable element of the vertical support of the main frame of the other half-passageway; and means for winding the strap on the strap support for drawing the vertical support of the other half-passageway toward the vertical support of the one half-passageway.

17. The passenger passageway of claim 16, further comprising a locking device for locking the half-passageways together.

* * * * *